US011410825B2

(12) United States Patent
Engewald

(10) Patent No.: US 11,410,825 B2
(45) Date of Patent: Aug. 9, 2022

(54) DISCONNECTING DEVICE FOR INTERRUPTING A DIRECT CURRENT OF A CURRENT PATH AS WELL AS A CIRCUIT BREAKER

(71) Applicant: Ellenberger & Poensgen GmbH, Altdorf (DE)

(72) Inventor: Manuel Engewald, Nuremberg (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 67 days.

(21) Appl. No.: 17/101,154

(22) Filed: Nov. 23, 2020

(65) Prior Publication Data

US 2021/0074499 A1 Mar. 11, 2021

Related U.S. Application Data

(63) Continuation of application No. PCT/EP2019/063095, filed on May 21, 2019.

(30) Foreign Application Priority Data

May 23, 2018 (DE) ..... 102018208119

(51) Int. Cl.
*H01H 50/54* (2006.01)
*H01H 50/42* (2006.01)
(Continued)

(52) U.S. Cl.
CPC ..... *H01H 50/42* (2013.01); *H01H 50/021* (2013.01); *H01H 50/546* (2013.01); *H01H 33/596* (2013.01)

(58) Field of Classification Search
CPC .... H01H 50/42; H01H 50/021; H01H 50/546; H01H 33/596; H01H 51/065
(Continued)

(56) References Cited

U.S. PATENT DOCUMENTS 2,121,657 A * 6/1938 Fisher ..... H01H 51/065 335/262
4,243,964 A * 1/1981 Bogner ..... H01H 51/065 200/DIG. 42
(Continued)

FOREIGN PATENT DOCUMENTS

DE 3503431 A1 8/1985
DE 3418859 C2 1/1992
(Continued)

*Primary Examiner* — Shawki S Ismail
*Assistant Examiner* — Lisa N Homza
(74) *Attorney, Agent, or Firm* — Laurence A. Greenberg; Werner H. Stemer; Ralph E. Locher

(57) ABSTRACT

A disconnecting device interrupts a direct current of a current path containing a hybrid switch which has a current-carrying mechanical contact system and a semiconductor switching system connected in parallel thereto. The contact system has a fixed contact and a moving contact. The moving contact is mounted on a contact bridge being coupled to a drive system moving the moving contact in a switching movement from an open position into a closed position resting against the fixed contact with a contact force. A first magnet element is mounted on the contact bridge and spaced apart from a stationary second magnet element by an air gap such that, when a current flows through the contact bridge, a magnetic field is produced in the first magnet element and the first and second magnet elements are magnetically attracted. The attraction produces a magnetic force directed in the same direction as the contact force.

9 Claims, 6 Drawing Sheets

(51) Int. Cl.
*H01H 50/02* (2006.01)
*H01H 33/59* (2006.01)

(58) Field of Classification Search
USPC ..... 335/2
See application file for complete search history.

(56) References Cited

U.S. PATENT DOCUMENTS

| | | | | |
|---|---|---|---|---|
| 4,593,260 | A | 6/1986 | Guero et al. | |
| 4,626,951 | A | 12/1986 | Nagao | |
| 10,483,072 | B2 | 11/2019 | Koepf et al. | |
| 2012/0175344 | A1* | 7/2012 | Tachikawa | H01H 9/443 218/26 |
| 2013/0021121 | A1* | 1/2013 | Uchida | H01H 51/065 335/131 |
| 2014/0002215 | A1* | 1/2014 | Ionescu | H01H 50/18 335/18 |
| 2014/0167892 | A1* | 6/2014 | Hirabayashi | H01H 51/065 335/203 |
| 2015/0054606 | A1 | 2/2015 | Naka et al. | |

FOREIGN PATENT DOCUMENTS

| | | | |
|---|---|---|---|
| FR | 2570869 | A1 | 3/1986 |
| WO | 2017005450 | A1 | 1/2017 |

* cited by examiner

X – X

XI – XI

DISCONNECTING DEVICE FOR INTERRUPTING A DIRECT CURRENT OF A CURRENT PATH AS WELL AS A CIRCUIT BREAKER

CROSS-REFERENCE TO RELATED APPLICATION

This application is a continuation, under 35 U.S.C. § 120, of copending international application No. PCT/EP2019/063095, filed May 21, 2019, which designated the United States; this application also claims the priority, under 35 U.S.C. § 119, of German patent application No. 10 2018 208 119, filed May 23, 2018; the prior applications are herewith incorporated by reference in their entirety.

BACKGROUND OF THE INVENTION

Field of the Invention

The invention relates to a disconnecting device for interrupting a direct current of a current path, in particular for a circuit breaker, containing a hybrid switch, which has a current-carrying mechanical contact system and a semiconductor switching system connected in parallel thereto. The invention further relates to a circuit breaker with such a disconnecting device.

A reliable disconnection of electrical components or equipment from a switch or current path is, for example, desirable for purposes of installation, assembly, or service, as well as also, in particular, for general protection of the person. A corresponding switch unit or disconnecting device must therefore be capable of carrying out a disconnect under load, hence without a prior switching off of the voltage source which supplies the current path.

Power semiconductor switches can be used for the disconnect of the load. These switches do, however, have the disadvantage that, even in normal operation, there are unavoidable power losses at the semiconductor switches. Moreover, it is typically not possible to ensure a galvanic disconnect and thereby reliable protection of the person with this type of power semiconductors. In contrast, if mechanical switches (switch contacts) are used for the load disconnect, a galvanic disconnect of the electrical device from the voltage source is likewise established when the contact is opened.

The electrical contacts of such a mechanical switch or contact system are often configured as one stationary fixed contact and as one moving contact that is movable in relation to the fixed contact. The moving contact is hereby movable in relation to the fixed contact and can be switched from a closed position to an open position. This means that for switching the contact system or switching unit, the moving contact is moved between the open position and the closed position by means of a switching movement.

In the closed position, the contacts of the contact system typically form a very small contact point where the flow of current through the contact system is concentrated. During operation, magnetic effects occur hereby, in particular, the so-called "Holm's constriction force", which exert a force on the contacts that releases the physical contact between the moving and fixed contacts. In order to avoid this, such a contact system typically has a spring element, which presses the moving contact with a spring force against the fixed contact, i.e. impinges with an additional contact force or contact pressure directed along the closed position.

In the event of a residual or overload current, it can however occur that the constriction force can exceed the contact force, whereby an undesired loss of contact can occur. In particular, in the case of direct current voltages, that need to be switched, of above 24 Volt (direct current), switching arcs often occur when the current-carrying electrical contacts are disconnected, inasmuch as the electrical current flows onwards along the arc path in the form of an arc discharge following the opening of the contacts. Since such switching arcs may not automatically extinguish in certain circumstances with direct current voltages starting at about 50 volts and direct currents starting at about 1 ampere, the contact system may be damaged or completely destroyed.

So-called hybrid disconnecting devices, which have a hybrid switch, are conceivable. Such a hybrid switch traditionally has a mechanical contact system and a semiconductor switching system connected in parallel. The semiconductor switching system has at least one power semiconductor switch, which opens when the contact system is closed, i.e. is not electrically conductive, and which, upon opening of the contact system, is at least temporarily current-conductive.

In particular, when a system is switched on, the semiconductor switching system is activated first and then, after a slight delay, once the flow of current has stabilized, the contact system is closed. Subsequently, the semiconductor switching system is deactivated and the mechanical contact system takes over the entire current. Switching off is correspondingly carried out in reverse order. This causes the electric current of the arc to be conducted or commutated from the contacts of the contact system to the semi-conductor switching system, whereby the arc between the switching contacts of the contact system is extinguished or does not even initially occur.

With such a hybrid disconnecting device, it is thus possible, at least in a limited current range, to reliably prevent the switching arc between the contacts during a switching operation in which the moving contact is moved to the open position, i.e. the mechanical contact system is opened. The disconnecting device is suitably equipped with a fuse, which is connected in series to the hybrid switch. The fuse ensures a reliable protection of the system at currents above this range of currents.

It must be ensured that that the hybrid switch can securely carry the residual or overload current when using such a disconnecting device in a circuit breaker, since a dependable response of the fuse/breaker within a specific characteristic curve will not be ensured. In order to ensure the response of the breaker within the characteristic curve, including allowing for the effects of aging, an excess current of up to a few kiloamperes (kA) must reliably be carried by the mechanical contact system. Consequently, a manifold increase in the contact pressure is required over that which would be needed for low resistance contact of the contact system in a rated current range.

In order to ensure secure response of the breaker, it is, for example, possible that one or a plurality of spring elements that are used to generate the contact pressure are oversized such that the contact force or the contact pressure has a sufficient reserve upon occurrence of constriction force, for example, also as regards mechanical vibrations. In so doing, both the manufacturing costs as well as also the necessary space requirements for the disconnecting device are however disadvantageously increased. Moreover, comparably higher performances are required for switching and holding of the contact system.

In particular, it is conceivable in contact systems with only one fixed contact and one moving contact that the moving contact is implemented as a (conductor) loop. During operation, the current flowing through the loop creates a magnetic field, which causes a magnetic force in support of the contact force. In this manner, a compensation of the constriction force is made possible. The effect is independent of the direction of current flow.

It is also conceivable, for example, to directly or by means of guide plates, orient a magnetic field of a permanent magnet in the area of the contact system in such a way that, in interaction with a magnetic field surrounding the moving contact in the course of the current flaw, a beneficial effect on the contact pressure is achieved. In so doing, the direction of the magnetic force is dependent on the direction of current flow.

BRIEF SUMMARY OF THE INVENTION

The invention is based on the task of specifying a particularly suitable disconnecting device for interrupting the direct current of a current path. The invention is also based on the task of specifying a circuit breaker with a corresponding disconnecting device.

The disconnecting device according to the invention is suitable and arranged for interrupting the direct current of a current path, in particular, for a circuit breaker switched into the current path. The hybrid disconnecting device, in particular, has a hybrid switch to interrupt the direct current of the current path.

The hybrid switch has a switchable mechanical contact system. Both a purely mechanical as well as an electromechanical contact system are hereinafter to be understood to be "mechanical contact systems."

"Switching," here and in the following, is understood to be, in particular, a mechanical or galvanic contact separation ("opening") and/or a contact closure ("closing") of the contact system. The contact plug of the contact system is a semiconductor switch system of the hybrid switch connected in parallel. In other words, the hybrid switch has a parallel connection of the contact system and of the semiconductor switch system. The semiconductor switch system expediently has at least one controllable power semiconductor switch.

The contact system has at least one stationary fixed contact and at least one moving contact that is movable in relation to this stationary fixed contact. The moving contact is carried by a current-carrying contact bridge (switching arm). The contact bridge can hereby, for example, be made of a copper material. The contact bridge is coupled to a drive system that moves the contact bridge—and thus the moving contact—from an open position to a closed position in which a contact force is applied to the fixed contact. In other words, the moving contact is subjected to a contact or surface pressure by the drive system, which ensures a secure contact. The drive system is preferably designed with a spring element, wherein the contact force (closing force) is effected as a preload or a restoring force of the spring element.

In accordance with the invention, at least one first magnetic element is arranged on the contact bridge, which is arranged at a distance from a stationary second magnetic element by means of an air gap in such a way that a current flow through the contact bridge causes a magnetic field in the first magnetic element and a magnetic attraction of the first and second magnetic elements takes place. In other words, the first magnetic element guides the magnetic field generated by the current-carrying contact bridge, with the magnetic circuit being closed via the air gap by the second magnetic element. In the course of this attraction or magnetic interaction, a magnetic force (pulling force) is produced in the same direction as the contact force, thus increasing the effective contact force of the moving contact to the fixed contact.

In addition to the contact force of the drive system, the flow of current causes a force to act between the two magnetic elements, which increases the contact pressure and thus counteracts the resulting constriction force. In other words, the contact force and the magnetic force are directed against the constriction force. The force effect is independent of the direction of current flow and therefore always amplifies the contact force.

Both the constriction force and the magnetic force increase proportionally to the square of the current flowing through the contact system. This means that in the case of an overload or residual current, both the constriction force and the magnetic force increase in the same manner, so that the magnetic force is always sufficiently dimensioned by the magnetic elements to compensate for the constriction force. In this manner, a reliable and operationally secure arrangement of the contacts is always ensured. In particular, unwanted lifting of the contacts is advantageously and easily counteracted, even in the event of a residual or overload current. Thus, a particularly suitable disconnecting device for interrupting direct current of a current path is realized.

In particular, the additional magnetic force for the contact pressure is only generated when it is needed to reliably press the moving contact onto the fixed contact. In contrast to the state of the art, it is therefore not necessary to provide a larger-sized contact pressure spring of the drive system, which reduces the manufacturing costs and the installation space required for the disconnecting device. Moreover, comparatively low pick-up and holding energies or powers are required for switching the contact system or alternatively the hybrid switch. Due to the reduced holding energy, the heat development of the drive system is reduced, which makes it possible to use a particularly compact drive system. Furthermore, higher rated currents can be achieved. In the cases of a bistable contact system, it is possible to use comparatively weak permanent magnets.

Since the mechanical contact system is part of a hybrid switch, no (switching) arcing occurs during switching, in particular when the contacts are opened. This means that effects due to contact erosion can essentially be ignored, which means that the balancing of the magnetic elements through the air gap can be set or specified in a particularly effective manner. In particular, the disconnecting device hereby shows substantially no change over its service life, at least as regards the force effect of the magnetic elements.

The stationary second magnetic element is preferably not part of the hybrid switch, in particular, not part of the moving contact system. The second magnetic element is, for example, arranged on a housing of the disconnecting device or of the circuit breaker, so that the point of application of the effected magnetic force is located outside or at a distance from the drive system of the contact system. In this way, the function of the magnetic elements is always guaranteed.

For example, the air gap has a clearance in the range of about 0.3 mm (millimeters) to 1 mm. Preferably, the air gap has a clearance of about 0.5 mm.

According to the invention, the current-carrying contact bridge itself is thus used to generate a magnetic field supporting the drive system. The magnetic elements thus act as an additional electromagnetic actuator or solenoid, the magnetic force of which acts directly on the contact bridge, so that the repulsion of the contacts that occurs at higher current intensities, in particular, in the kiloampere range (kA), is reliably and securely compensated. In particular, the contact system of the disconnecting device according to the invention does not require any additional permanent magnets to generate the pulling force or closing force (magnetic force), making the disconnecting device particularly cost-effective. Furthermore, the function is independent of the direction of current flow, so that the contact system and thus the disconnecting device can substantially be used in both directions.

Contrary to the state of the art, the pulling effect of the magnetic elements according to the invention enables an optimized current conduction by means of the contact bridge compared to the repulsion of a loop-shaped contact bridge (conductor loop). This enables a very compact design of the disconnecting device. Furthermore, a maximum effect is realized with closed contacts. In contrast, in the cases of greater travel of the contact (increased disconnect distance, higher voltages) a conductor loop would have to be configured correspondingly wide and would thus be ineffective. In this manner, the contact bridge itself can be configured in a particularly compact and material-saving manner, which further reduces power losses of the contact system.

In a suitable further development, the mechanical contact system has two fixed contacts and two moving contacts. Appropriately, in this case, the moving contacts are substantially moved simultaneously, i.e. synchronously, so that switching at both switching or contact points is substantially simultaneous. In other words, the contact system—and thus the hybrid switch—has two contact pairs of disconnection points that are preferably spaced apart. This enables a particularly operationally reliable switching of the contact system, whereby the switching behavior of the disconnecting device is improved.

In an advantageous embodiment, the first magnetic element and the second magnetic element are each made of a soft magnetic material, in particular, made of a soft magnetic ferrous material. A soft magnetic material or raw material in this context is, in particular, a ferromagnetic material which is slightly magnetized in the presence of a magnetic field. This magnetic polarization is, in particular, generated by the electric current in the contact bridge through which the current flows. The polarization increases the magnetic flux density in the respective magnetic element many times over. This means that a soft magnetic material "amplifies" an external magnetic field by its respective material permeability. This ensures that the highest possible magnetic force is generated between the magnetic elements so that the constriction force is always reliably compensated.

Soft magnetic materials have a coercive field strength of less than 1000 A/m (amperes per meter). A magnetic soft iron (RFe80-Rfe120) with a coercive field strength of 80 to 120 A/m is, for example, used as a soft magnetic material. It is also conceivable, for example, to use a cold rolled strip, such as EN10139-DC01 +LC-MA ("transformer plate"), which makes for a particularly cost-effective design.

In a conceivable embodiment, the first magnetic element and the second magnetic element are configured as a pair of yoke-anchor-pairs. One of the magnetic elements is configured as a more or less U-shaped or horseshoe-shaped magnet yoke, whereas the respective other magnetic element is designed as a flat anchor plate.

In an advantageous design, the contact bridge is approximately rectangular, whereby two moving contacts are provided, which are arranged on the opposite end faces of the contact bridge. This allows a particularly simple construction of the moving parts of the contact system. Preferably, the moving contacts are arranged on a common plane surface of the contact bridge, whereby the coupling to the drive system suitably takes place on the plane surface of the contact bridge opposite the moving contacts.

In an appropriate conformation, the first magnetic element is designed as a U-shaped magnet yoke, which rests against the contact bridge in the area of the horizontal U-shaped member. The first magnet element or magnet yoke herein lies with the horizontal U-shaped member, in particular, in the area of the mechanical coupling to the drive system, wherein the magnet yoke encompasses the contact bridge at least in sections by means of the vertical U-shaped member.

Appropriately, the vertical U-shaped members encompass the contact bridge in such a way that the vertical U-shaped members of the first magnetic element of the contact bridge project in the direction of the fixed contacts and are arranged at a distance, by means of a respective air gap on the free end side, from a second magnetic element configured as an anchor plate. The second magnetic element or the anchor plate is herein substantially oriented transversely to the contact bridge, i.e. approximately parallel to the horizontal U-shaped member of the first magnetic element or magnet yoke.

In an appropriate further development, the switching movement of the contact bridge, i.e. the movement of the contact bridge caused by the drive system and/or the magnetic elements, is linear. Here and in the following, the conjunction "and/or" is to be understood in such a way that the features linked by means of this conjunction are configured both together and as alternatives to each other. In this manner, a simple implementation and arrangement from the construction standpoint of the drive system and the contact bridge, as well as of the magnet elements is possible.

In an alternative, equally advantageous design, the contact bridge is essentially U-shaped, with two moving contacts each arranged at one free end of each vertical U-shaped member. The alternative design of the contact bridge can be produced at low cost and allows particularly large separation distances between the contacts, i.e. large gaps between the contacts in the open position. In this configuration, the drive system is preferably configured as a hinged armature magnet system, which makes it possible to realize a particularly cost-effective, compact, and durable disconnecting device.

An additional or further aspect of this configuration provides that a first magnetic element implemented as an anchor plate is arranged along the vertical U-shaped member of the contact bridge. Furthermore, two second magnetic elements configured as U-shaped or horseshoe-shaped magnet yokes are provided, which are arranged in the area of the fixed contacts and which each have two vertical U-shaped members, which at least partially encompass the vertical U-shaped members of the contact bridge arranged opposite each other. This ensures a particularly uniform and generating or effecting of the supporting magnetic force in the area of the moving contacts.

In a particularly suitable further development, the switching movement of the contact bridge is carried out by means of a swivel or rotational movement. The swiveling or rotational axis is herein, in particular, oriented along or parallel to the horizontal U-shaped member of the contact bridge. Preferably, the contact bridge is herein fastened to or held by a more or less U-shaped spring element of the drive system, which is made of spring steel, for example, as a stamped part. The swiveling or rotational movement is herein, in particular, achieved by a hinged armature magnet system, whereby the contact pressure is caused by the bending elasticity of the spring element. The swivel or rotational movement makes it possible to easily create or implement particularly large separation distances between the contacts, whereby a particularly secure and reliable galvanic separation of the separation device is achieved.

Furthermore, the design with a U-shaped spring element, whose vertical U-shaped member is substantially aligned with that of the contact bridge, is particularly advantageous in that the contact system is reliably held in the closed position even in the event of external vibrations or shocks. In particular, with such rotational contact systems, it is possible to position the center of mass of the moving contact bridge close to the center of rotation or the axis of rotation.

In a preferred application, the disconnecting device described above is part of a circuit breaker. The circuit breaker is switched in a current circuit between a direct current power source and a load or a consumer, so that when the circuit breaker is operated, the disconnecting device galvanically separates the load or consumer from e direct current power source.

The circuit breaker is, in particular, configured as a hybrid circuit breaker or as a hybrid (power) relay or even as a circuit breaker device with a downstream fuse, and has a supply connection, through which a power line on the mains side, and thus carrying current, is connected, as well as a load connection, through which the power line on the load side can be connected.

Preferably, the circuit breaker is suitable and set up for switching high voltages and direct currents, for example in the range of 6 kA. For this purpose, the disconnecting device is appropriately dimensioned in order to conduct and securely switch such high currents. The disconnecting device according to the invention thus ensures secure and reliable switching of the circuit breaker, even in the case of high overload currents or residual currents.

Other features which are considered as characteristic for the invention are set forth in the appended claims.

Although the invention is illustrated and described herein as embodied in a disconnecting device for interrupting a direct current of a current path as well as a circuit breaker, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a schematic view of a current path with a direct current power source and with a consumer as well as with a circuit breaker switched in between;

DETAILED DESCRIPTION OF THE INVENTION

Figure 1:
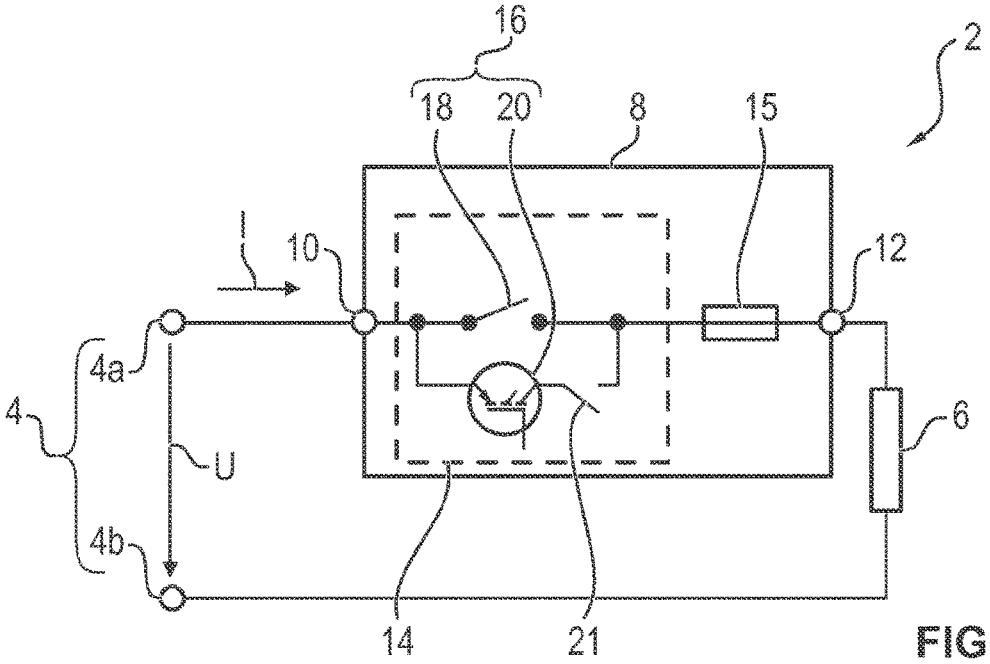

The following is a summary list of reference numerals and the corresponding structure used in the above description of the invention:

Parts and scales that correspond to one another are always referred to with the same reference signs in all figures.

Referring now to the figures of the drawings in detail and first, particularly to FIG. 1 thereof, there is shown a schematic and simplified representation of a current path 2 for carrying of a (direct) current I. The current path 2 has a direct current power supply 4 with a positive pole 4*a* and with a negative pole 4*b*, between which there is an operating voltage U. A load or consumer 6 is switched in the current path 2. A circuit breaker 8 is switched between the positive pole 4*a* and the load 6, for example, in the form of a hybrid power relay.

The circuit breaker 8 is connected on the one side, by means of a power supply connection 10, to a power supply line that is located on the supply side and is thus current-carrying, and on the other side is connected, by means of a load connection 12, to the load-side current output line.

The circuit breaker 8 has a series connection of a hybrid disconnecting device 14 and a breaker 15. The disconnecting device 14 is herewith configured with a hybrid switch 16, which has a mechanical contact system 18 and a series connection of a semiconductor switching system 20 and an (auxiliary) relay 21 connected in parallel. The semiconductor switching system 20 is represented in FIG. 1, as an example, by means of a controlled power semiconductor switch, in particular, by means of an insulated gate bipolar transistor (IGBT).

The additional relay or disconnecting element 21 hereby ensures a galvanic disconnect of the current path 2 in the case of a triggering of the disconnecting device 14. The disconnecting device 14 is suitable and set up to securely carry the current I in the case of a residual or overload current until the breaker 15 trips. Secure carrying of the current I means, in particular, that the contacts of the mechanical contact system 18 are not interrupted or removed.

In the following, a first embodiment of the contact system 18 is explained in more detail using FIG. 2 to FIG. 6.

Figure 2:
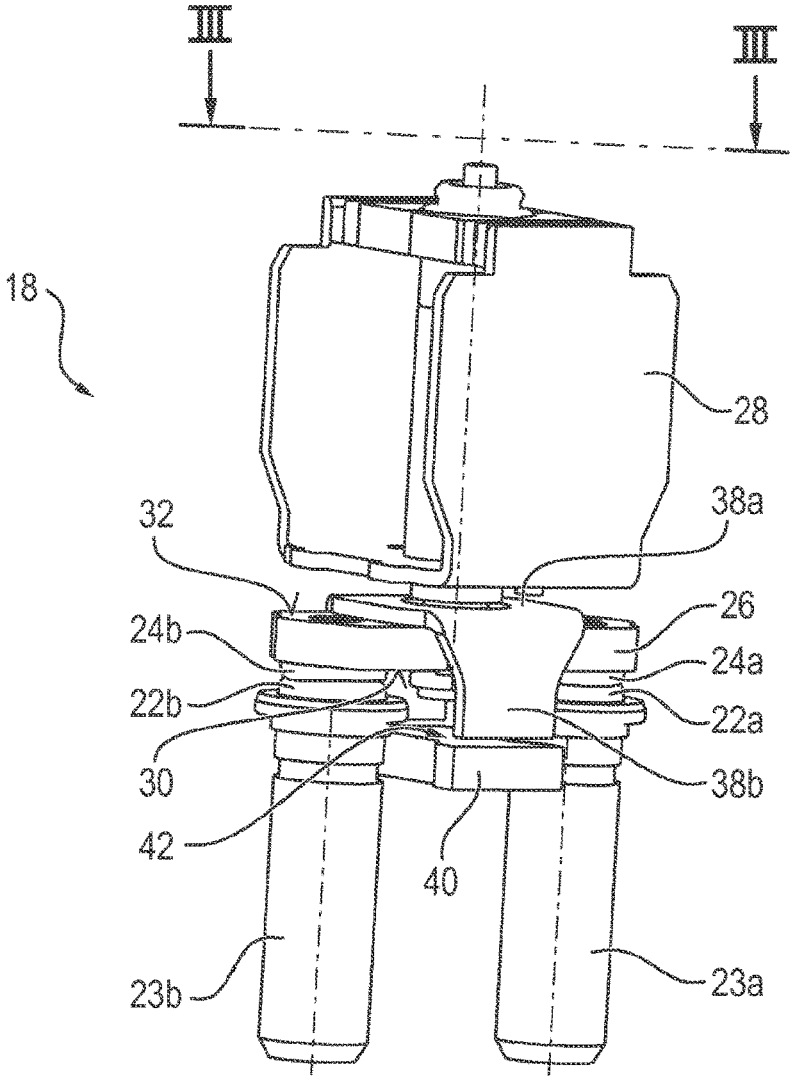
FIG. 2 is a perspective view of a mechanical contact system of the circuit breaker.

The contact system 18 shown in FIG. 2 has two stationary fixed contacts 22*a*, 22*b*, which are electrically conductively connected to the supply connection 10 on the one side and to the load connection 12 on the other side. The fixed contacts 22*a*, 22*b* are each conductively connected to an associated electrical connection 23*a*, 23*b*, by means of which the contact system 18 can be connected to current path 2.

The contact system 18 also has two moving contacts 24*a*, 24*b*, which are carried by a common, current-carrying contact bridge 26. The contact bridge 26 is coupled with a drive system 28, by means of which the contact bridge 26 can be moved towards or away from the fixed contacts 22*a*, 22*b*.

To switch the contact system 18, the contact bridge 26 can be moved from an open position to a closed position by means of the drive system 28 in the course of a switching movement. FIGS. 2 to 6 show the contact system 18 in the closed position, in which the moving contacts 24*a*, 24*b* at the respective contact points are in electrically conductive contact with the respective opposite fixed contacts 22*a*, 22*b*.

In the embodiment example of FIGS. 2 to 6, the switching movement brought about by the drive system 28 when opening and closing the contact system 18 takes place linearly along a (operating) direction of the drive system 28 which is perpendicular to the contacts 22*a*, 22*b*, 24*a*, 24*b*.

The elongated, straight, more or less plate-shaped contact bridge 26 is, for example, manufactured as a stamped copper part. The moving contacts 24*a* and 24*b* are arranged on the opposing end faces of the more or less rectangular contact bridge 26. The moving contacts 24*a* and 24*b* are arranged on the flat surface or lower side 30 of the contact bridge 26 facing the fixed contacts 22*a* and 22*b*. The drive system 28 is located on the opposing flat side or top surface 32 of contact bridge 26.

Figure 3:
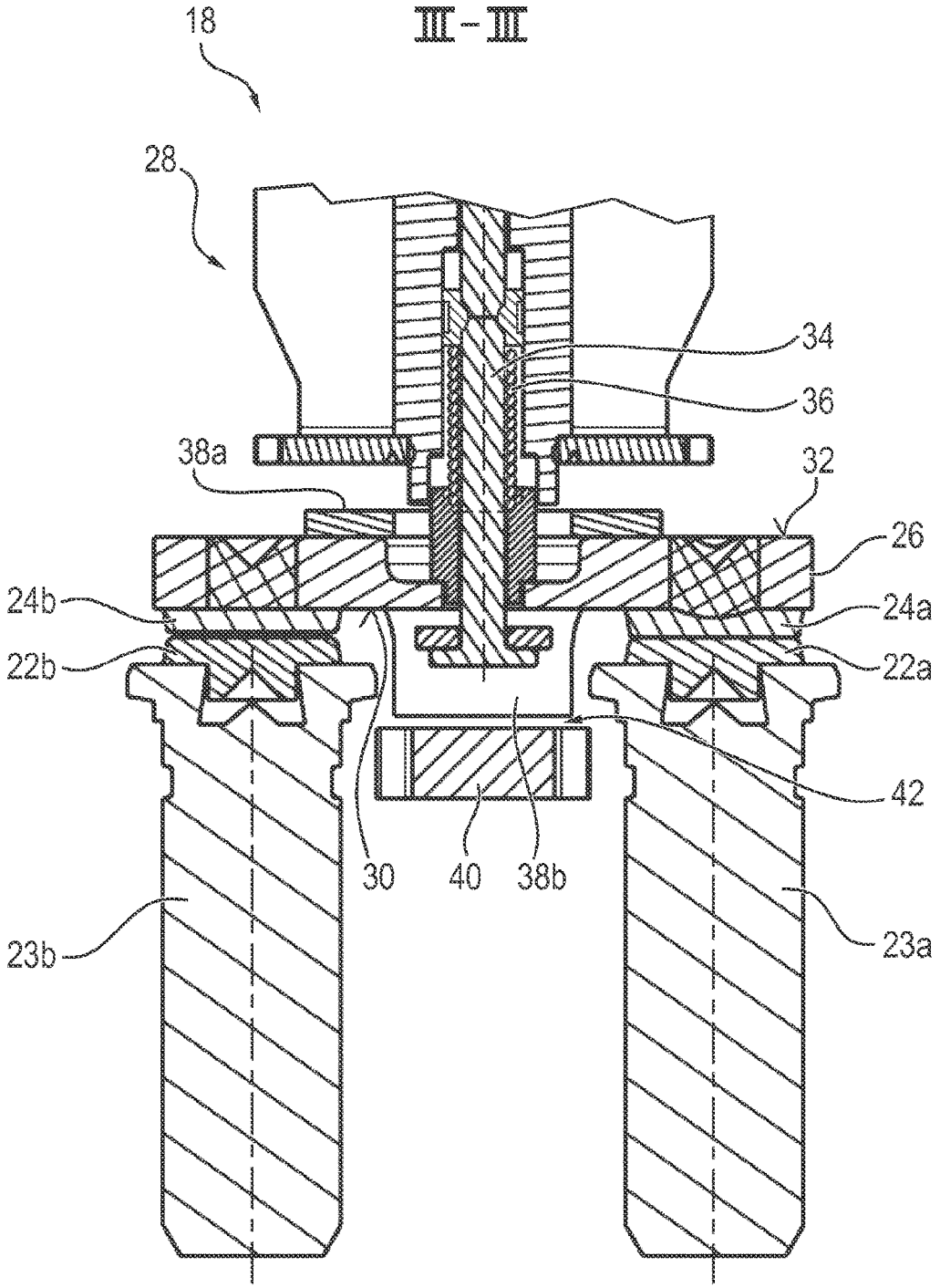
FIG. 3 is a cross-sectional view of the contact system.

FIG. 3 shows a cross-sectional view of a longitudinal section of the contact system 18 along the III-III line shown in FIG. 2. As can be seen in a comparatively clear manner in the cross-sectional view of FIG. 3, the drive system 28 has a spring-loaded plunger 34 for actuating or moving the contact bridge 26.

Figure 4:
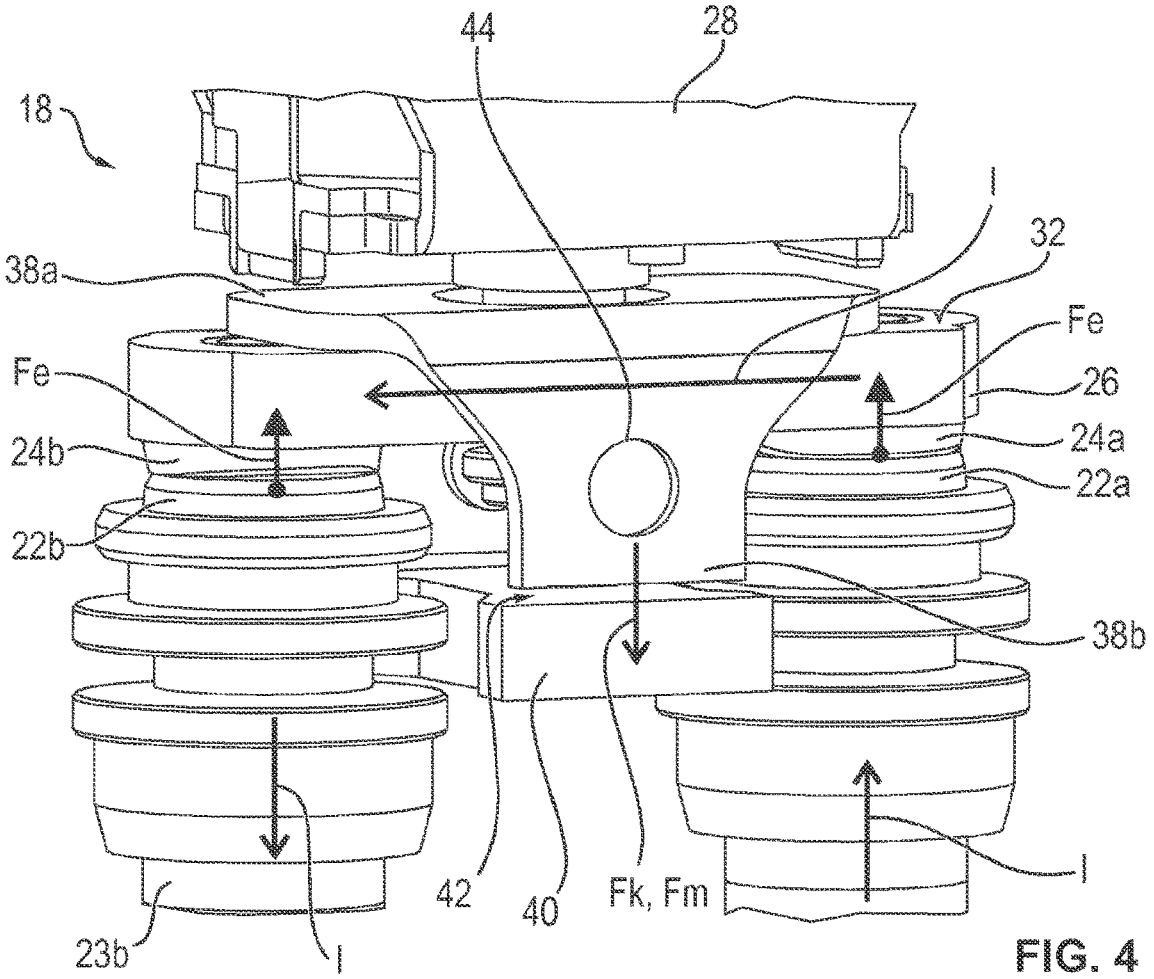
FIG. 4 is a perspective view of the contact system.

The plunger 34 is surrounded at least in sections by a spring element 36 which is designed, for example, as a coil spring and which is also hereinafter referred to as a contact pressure spring. The contact pressure spring 36 is arranged in such a way that, in the closed position, there is at least a certain spring tension, the restoring force of which acts as contact force Fk or contact pressure on the contact bridge 26 and thus on the moving contacts 24*a* and 24*b* (FIG. 4). In other words, the moving contacts 24*a* and 24*b* are subjected to a contact pressure by means of the actuator system 28, which ensures a secure contact of the contacts 22*a*, 22*b*, 24*a*, 24*b*. The contact force Fk is oriented along the direction of actuation of the drive system, i.e. in the direction along which the linear switching movement of the contact system 18 takes place.

A magnetic element 38 is arranged on the contact bridge 26. The magnetic element 38 is designed as a more or less horseshoe-shaped or U-shaped magnet yoke, the horizontal U-shaped member 38*a* of which is located at the top side 32 of the contact bridge 26. The U-shaped member 38*a* has a central, further unspecified, circular recess through which the plunger 34, at least in sections, is passed. The U-shaped member 38*a* is arranged transversely, i.e. substantially perpendicular to the contact bridge 26.

A vertical U-shaped member 38*b* is formed onto the opposite end faces of the U-shaped member 38*a*. The U-shaped members 38*b* are oriented perpendicular to the U-shaped member 38*a* and the contact bridge 26, i.e. essentially parallel to the plunger 34. The U-shaped members 38*b* hereby encompass the contact bridge 26, so that the U-shaped members 38*b*, at their free ends, at least partially protrude from the lower side 30 of the contact bridge 26 axially, i.e. they protrude beyond the lower side 30. A second magnetic element 40 is arranged at a distance from the free ends of the U-shaped members 38*b*. The magnetic element 40, which is designed as a flat, more or less rectangular anchor plate, is arranged parallel to the U-shaped member 38*a*, i.e. transverse to the contact bridge 26.

In the closed position shown in the figures, the free ends of the U-shaped members 38*b* are each kept at a distance from the anchor plate 40 by means of an air gap 42. The anchor plate 40 is stationary, i.e. arranged fixed to a housing of the disconnecting device 14 or of the circuit breaker 8. The magnet yoke 38 and the anchor plate 40 are each made of a soft magnetic material, in particular of a soft magnetic ferrous material.

Figure 5:
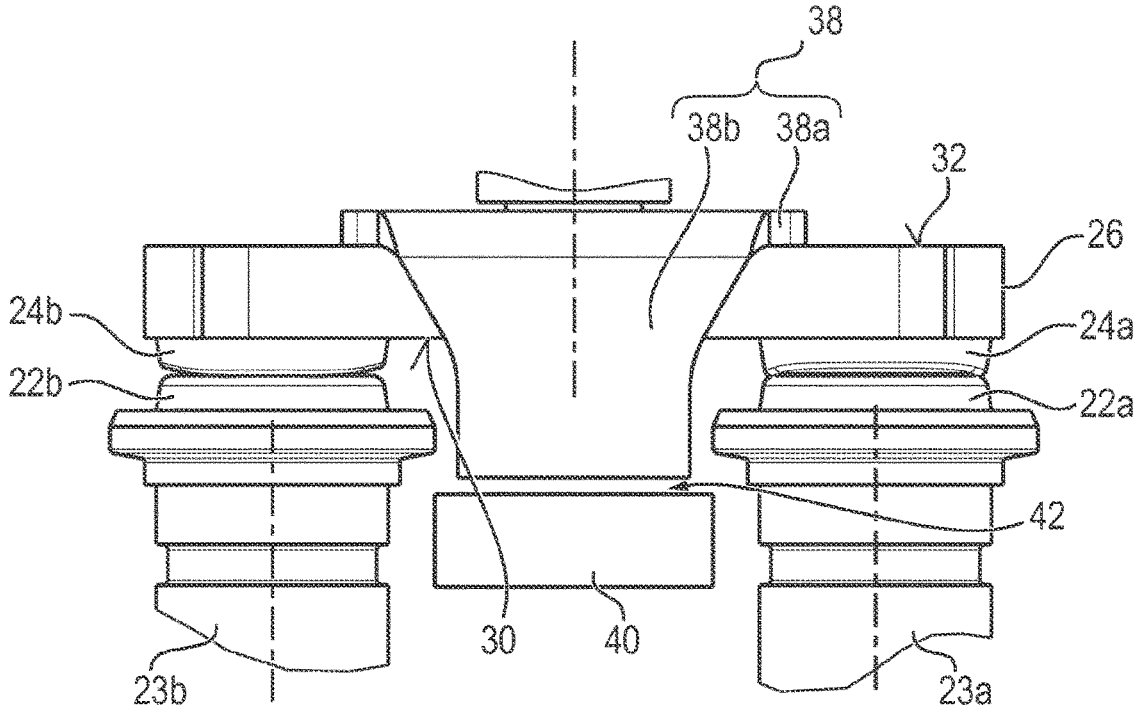
FIG. 5 is a side view of the contact system.

As can, in particular, be seen in FIG. 4 and FIG. 5, the U-shaped members 38*b* have a more or less funnel-shaped cross-sectional shape in the plane defined by the longitudinal directions of the U-shaped members 38*b* and the contact bridge 26. The U-shaped member 38*b* hereby has a truncated cone or trapezoid-shaped area, which is formed at the base on the U-shaped member 38*a*, and a more or less rectangular area, which is formed on the base side of the trapezoid-shaped area opposite the base. The rectangular area hereby forms the free end of the U-shaped member 38*b*. The U-shaped member 38*b* can have a circular recess 44, as shown in FIG. 4.

Figure 6:
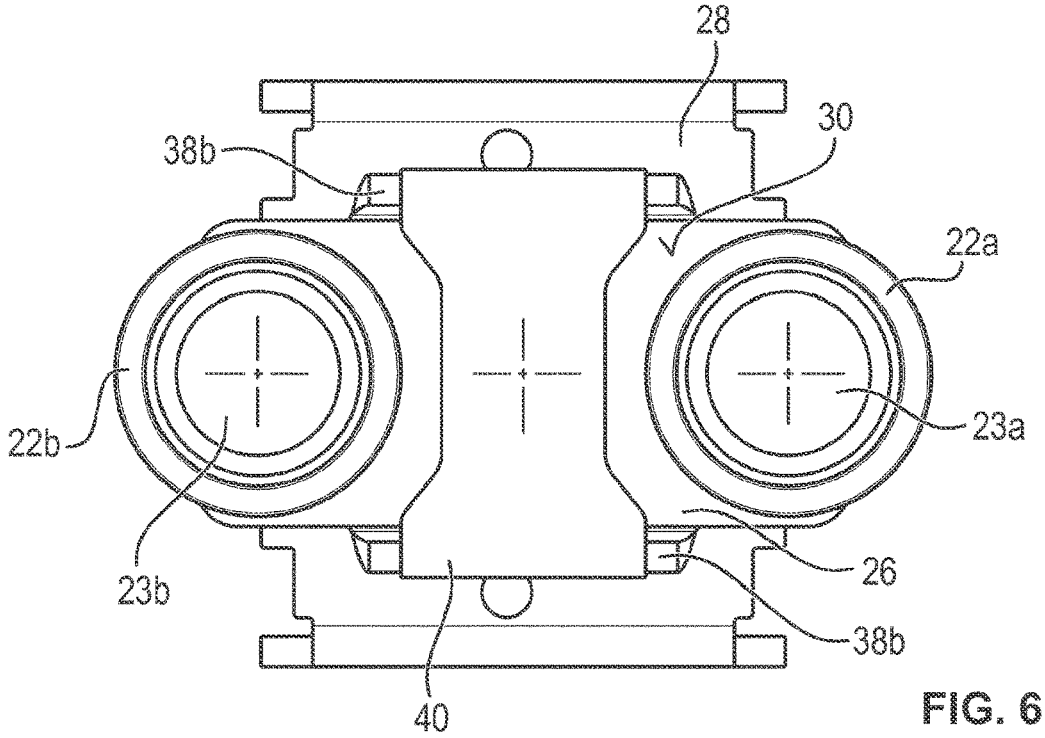
FIG. 6 is a top view with sight of a lower side of the contact system.

As can be seen, in particular, in the top view with a view of the underside 30, shown in FIG. 6, the anchor plate 40 has a more or less hourglass-shaped, cross-sectional shape, i.e. dual-tapered to the center, in the plane spanned by the longitudinal directions of the contact bridge 26 and the U-shaped member 38*a*. The waisted or tapered section is located centrally along the respective long side and in the area of the fixed contacts 22*a* and 22*b*.

As schematically shown by arrows in FIG. 4, the electrical current I is supplied into the contact bridge 26 via the fixed contact 22*a* and the moving contact 24*a*, and is discharged from the contact system 18 via the moving contact 24*b* and the fixed contact 22*b*. Due to magnetic effects, at each of the contact points formed by the contact pairs 22*a*, 24*a* and 22*b*, 24*b*, a constriction force Fe occurs which is oriented opposite to the contact force Fk.

The contact force Fk, i.e. the spring strength of the contact pressure spring 36, is, in particular, dimensioned in such a way that in the case of a normal current, i.e. an electric current I with a current strength less than or equal to a normal or nominal value, the constriction force Fe is reliably compensated. This means that the contact force Fk at a normal current is always greater than the constriction force Fe, so that unwanted lifting of the moving contacts 24*a*, 24*b* from the fixed contacts 22*a*, 22*b* is reliably and simply prevented.

The magnetic elements 38 and 40 hereby prevent the constriction force Fe from separating the contacts 22*a*, 22*b*, 24*a*, 24*b* from each other in the event of a residual or overload current where the current I exceeds the nominal value. In the event of such an overcurrent, the contact force Fk of the contact pressure spring 36 is not sufficient to reliably compensate for the increasingly large constriction force Fe.

When a current flows through the contact bridge 26, the current I generates a magnetic field around the contact bridge 26. The magnetic field polarizes the soft magnetic yoke 38 and the soft magnetic anchor plate 40, whereby the magnetic flux density in the area of the magnetic elements 38, 40 is significantly increased compared to the surroundings. A magnetic circuit is thereby formed between the magnet yoke 38, the air gap 42 and the anchor plate 40.

The spacing by means of the air gap 42 thus creates an attracting magnetic force Fm between the magnet yoke 38 and the anchor plate 40. Since the anchor plate 40 is arranged stationary or fixed in the housing in the circuit breaker 8, the magnet yoke 38 is pulled towards the anchor plate 40. The resulting magnetic force Fm is therefore in the same direction as the contact force Fk of the contact pressure spring 36, so that the magnetic force Fm and the contact force Fk add up to a resulting total force which counteracts the constriction force Fe. The contact pressure between the contacts 22*a*, 22*b*, 24*a*, 24*b* is thereby increased, which reliably and securely counteracts lifting of the contacts 22*a*, 22*b*, 24*a*, 24*b*, even in the event of a residual or overload current.

The current-carrying contact bridge 26 thus generates a magnetic field supporting the drive system 28, the magnetic field being used to increase the contact pressure. When current flows through the contact bridge 26, the magnetic elements 38, 40 thus act as an additional electromagnetic actuator or solenoid, the magnetic force Fm of which acts through the U-shaped member 38*a* directly on the contact bridge 26 and thus on the moving contacts 24*a*, 24*b*.

In the following, an alternative, second embodiment of the contact system 18' is explained in more detail using FIG. 7 to FIG. 11.

In this embodiment, the contact bridge 26' is designed as a substantially U-shaped copper part, with the two moving contacts 24*a*, 24*b*, each arranged at one free end of a vertical U-shaped member 26'*a*.

A magnetic element 38' is respectively arranged in the form of an anchor plate along the vertical U-shaped members 26*a*' of the contact bridge 26'. In this embodiment, the drive system 28' of the contact device 18' is configured as a hinged armature magnet system, whereby only a more or less U-shaped spring element 46 coupled to the hinged armature is shown. The U-shaped members 26'*a* and the anchor plates 38', as well as the U-shaped members 46*a* are substantially stacked on top of one another.

The vertical U-shaped members 46*a* of the spring element 46 are substantially arranged flush with the U-shaped members 26*a*' of the contact bridge 26', wherein the horizontal U-shaped members 46*b* of the spring element 46 are spaced apart from the horizontal U-shaped members 26'*b* of the contact bridge 26'. In other words, the U-shaped members 46*a* have a greater length along the longitudinal direction of the member than the U-shaped members 26'*a*, so that the U-shaped member 46*b* is arranged above the U-shaped member 26'*b* along the longitudinal direction of the member.

The spring element 46 is made of a flexible elastic material, e.g. spring steel, so that a swiveling or rotational movement of the drive system 28' is realized by the substantially free-standing U-shaped member 46*b*. In particular, the U-shaped members 46*a* of the spring element 46 are herein held pivotable or rotatable in relation to a swivel or rotation axis S running parallel to the U-shaped member 46*b*.

Figure 7:
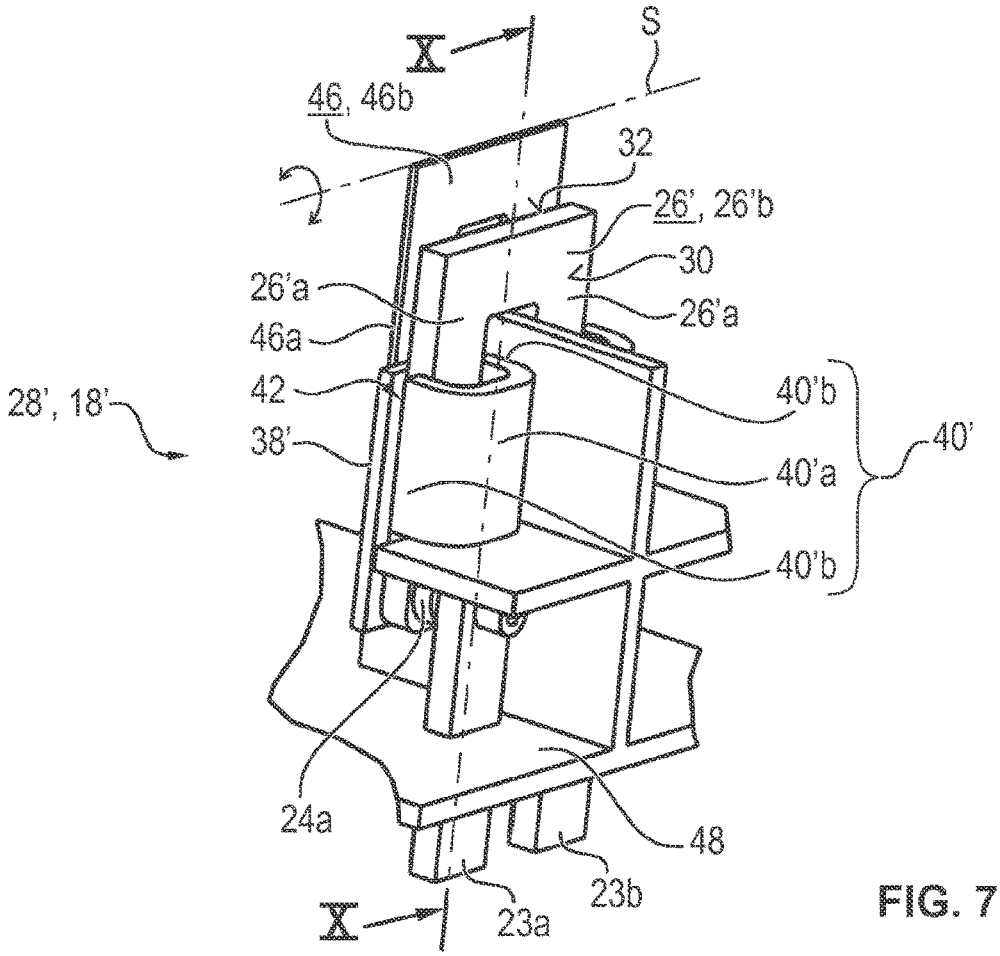
FIG. 7 is a perspective view of an alternative embodiment of the contact system in a closed position.
Figure 8:
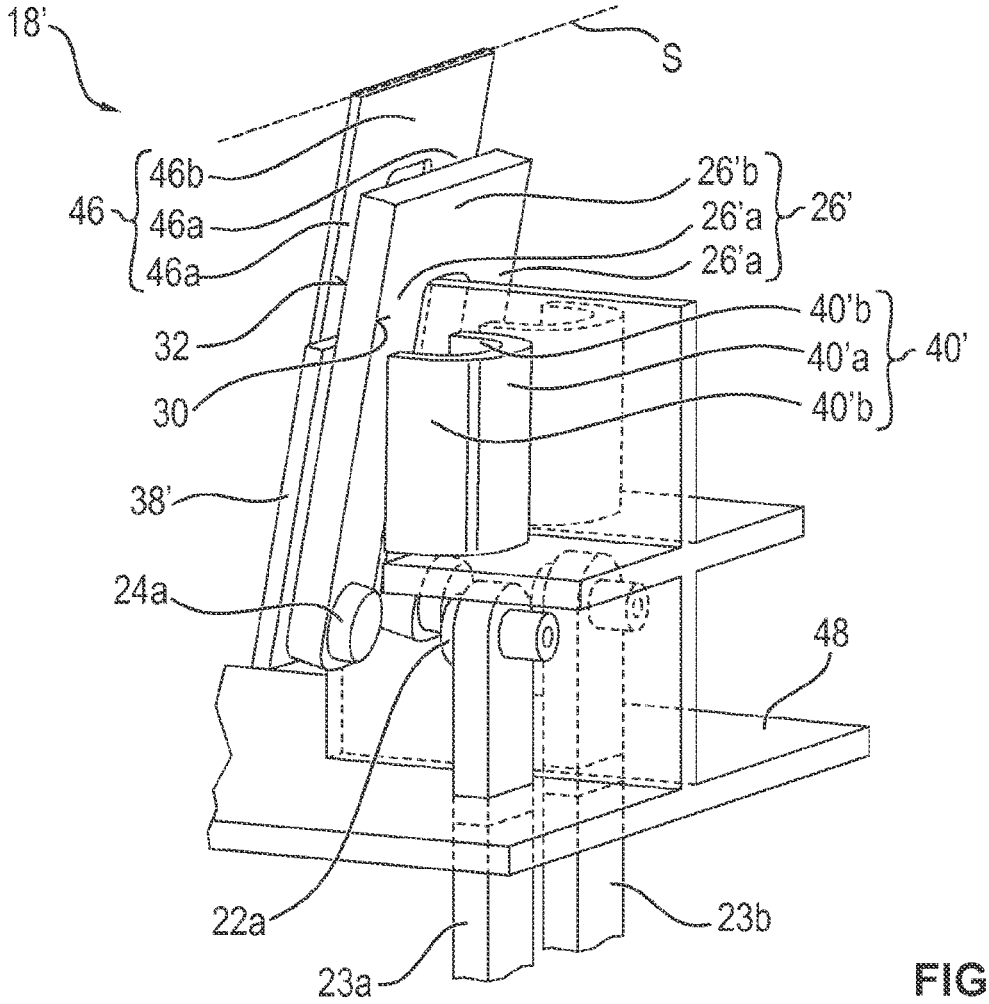
FIG. 8 is a perspective view of the alternative embodiment of the contact system in an open position.
Figure 9:
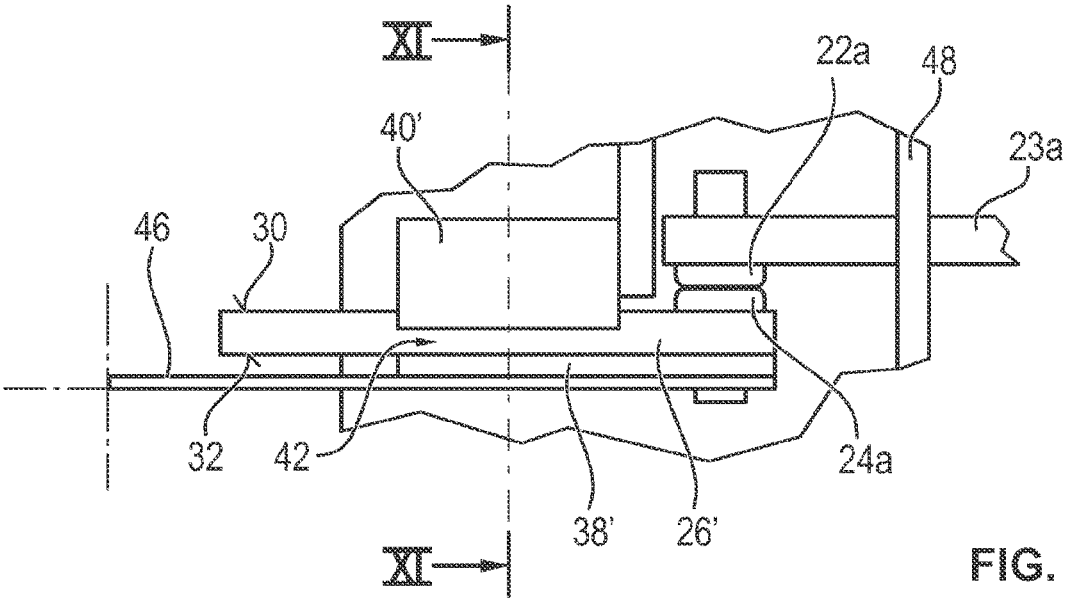
FIG. 9 is a side view partially showing the contact system in the alternative embodiment.

In this embodiment, the switching movement is thus carried out, in particular, by swiveling the contact bridge 26' about the swivel axis S. This swivel movement is indicated in FIG. 7, which shows the contact system 18' in a closed position, and in FIG. 8, which shows the contact system 18' in an open position. Comparatively large separation distances between contacts 22*a*, 22*b*, 24*a*, 24*b* are achieved due to the swivel or rotational movement.

In this embodiment, two stationary magnetic elements 40' are provided, which are fixed to an insulating, i.e. electrically non-conductive housing 48 of circuit breaker 8. The magnetic elements 40' are designed in cross-section as horseshoe-shaped or U-shaped magnet yokes, which extend at least in sections along the longitudinal direction of the U-shaped members 26'*a*, 46'. The magnet yokes 40' are herein substantially designed as cylindrically-shaped parts with a horseshoe or U-shaped base or cross-sectional area.

The magnetic elements 40' each have a horizontal U-shaped member 40*a*' oriented parallel to the U-shaped members 26'*a*, 46' in the closed position. Two vertical U-shaped members 40'*b* are formed onto the back-like U-shaped member 40*a*' of the magnet yoke 40'. In the closed position, the U-shaped members 40'*b* of the magnet yoke 40' embrace, at least in sections,—as, for example, shown in FIG. 9—the respective oppositely arranged vertical U-shaped member 26'*a* of the contact bridge 26', so that the air gap 42 is formed between the free ends of the U-shaped members 26'*a* and the respective anchor plate 38'.

Figure 10:
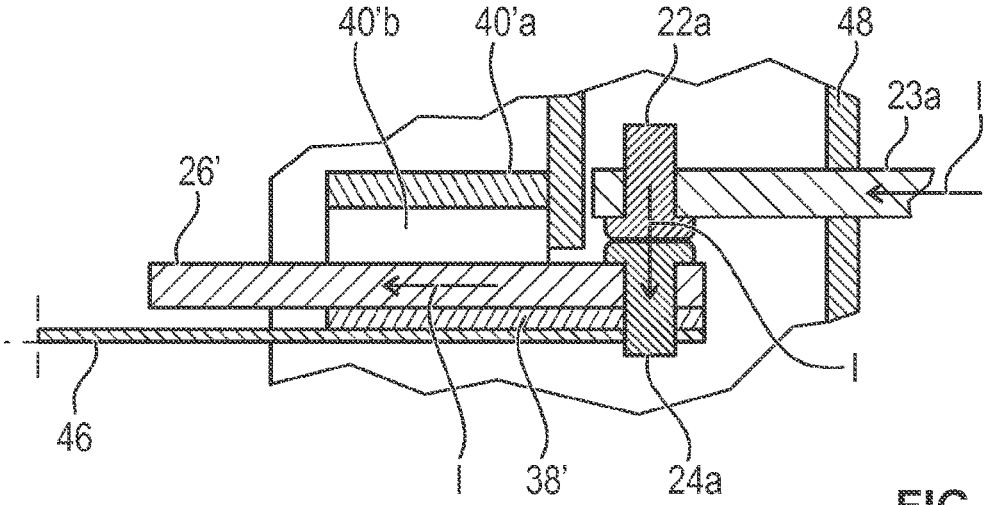
FIG. 10 is a cross-sectional view of a longitudinal section of the contact system.
Figure 11:
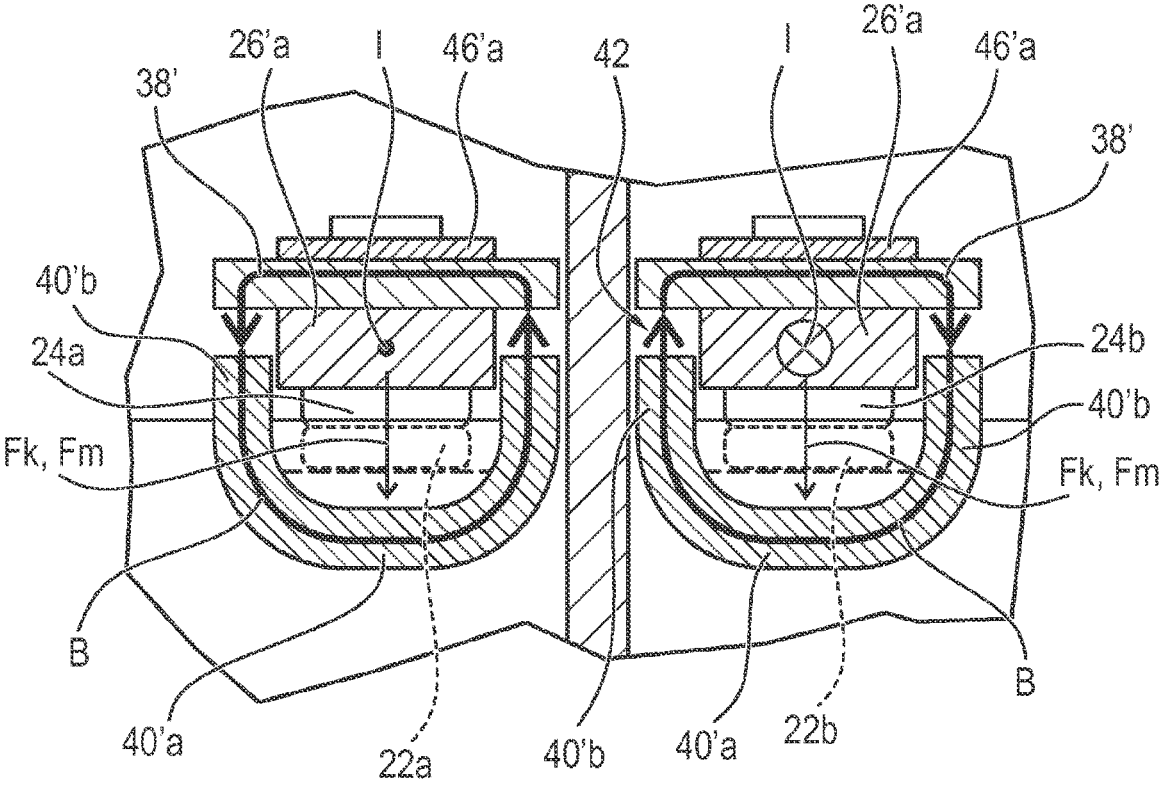
FIG. 11 is a cross-sectional view of a transverse section of the contact system.

As can be seen from the cross-sectional representations in FIG. 10 and FIG. 11, the current I generates a magnetic field B when flowing through the members 26'*a*, 26'*b* of the contact bridge 26', which, independent of the direction of the current, produces the magnetic force Fm, attracting the magnetic elements 38', 40' to each other, thus increasing the contact force Fk due to the spring tension of the spring element 46.

The invention is not limited to the embodiments described above. Instead, other variants of the invention can be derived by the person skilled in the art without leaving the scope of the subject matter of the invention. In particular, all individual features described in connection with the examples of implementation can also be combined with one another in other ways without going beyond the scope of the subject matter of the invention.

LIST OF REFERENCE SIGNS

2 current path
4 direct current power source
4*a* positive pole
4*b* negative pole
6 load/consumer
8 circuit breaker
10 power supply connection
12 load connection
14 disconnecting device
15 breaker
16 hybrid switch
18, 18' contact system
20 semiconductor switching system
22*a*, 22*b* fixed contact
23*a*, 23*b* connection
24*a*, 24*b* moving contact
26 contact bridge
26' contact bridge
26'*a*, 26'*b* U-shaped member
28, 28' drive system
30 flat surface/lower side
32 flat surface/top side
34 plunger
36 spring element/contact pressure spring
38 magnet element/magnet yoke
38*a*, 38*b* U-shaped member
38' magnet element/anchor plate
40 magnet element/anchor plate
40' magnet element/magnet yoke
40'*a*, 40'*b* U-shaped member
42 air gap
44 recess
46 spring element
46*a*, 46*b* U-shaped member
48 housing
U operating voltage
I current Fk contact force Fm magnetic force Fe constriction force S swivel axis/axis of rotation B magnetic field

The invention claimed is:

1. A disconnecting device for interrupting a direct current of a current path, comprising:

a hybrid switch having a current-carrying mechanical contact system and a semiconductor switching system connected in parallel with said current-carrying mechanical contact system, said current-carrying mechanical contact system having at least one stationary fixed contact, at least one moving contact, a current-carrying contact bridge, and a drive system;

said at least one moving contact is mounted on said current-carrying contact bridge and is coupled to said drive system, which moves said at least one moving contact in a switching movement from an open position into a closed position resting against said at least one stationary fixed contact with a contact force; and said current-carrying mechanical contact system further having at least one first magnet element and a stationary second magnet element, said at least one first magnet element mounted on said current-carrying contact bridge, said at least one first magnet element being spaced apart from said stationary second magnet element by an air gap such that, when a current flows through said current-carrying contact bridge, a magnetic field is produced in said at least one first magnet element and said first and second magnet elements are magnetically attracted defining an attraction, said attraction producing a magnetic force directed in a same direction as the contact force.

2. The disconnecting device according to claim 1, wherein:

said at least one stationary fixed contact is one of two fixed contacts; and said at least one moving contact is one of two moving contacts.

3. The disconnecting device according to claim 1, wherein said at least one first magnet element and said stationary second magnet element are each made of a soft magnetic material.

4. The disconnecting device according to claim 2, wherein:

said current-carrying contact bridge is a vertical U-shaped member having free ends; and said two moving contacts are each disposed on one of said free ends of said vertical U-shaped member.

5. The disconnecting device according to claim 4, wherein:

said at least one first magnet element is an anchor plate disposed along said vertical U-shaped member, and said stationary second magnet element is one of two second magnet elements implemented as magnet yokes, said two second magnet elements are disposed in an area of said fixed contacts, and each of said two second magnet elements have two vertical U-shaped members, which encompass a respective oppositely disposed said vertical U-shaped member of said current-carrying contact bridge, at least in sections.

6. The disconnecting device according to claim 4, wherein a switch movement of said current-carrying contact bridge is a swivel or rotational movement.

7. The disconnecting device according to claim 3, wherein said soft magnetic material is a soft magnetic ferrous material.

8. The disconnecting device according to claim 1, wherein the disconnecting device is a part of a circuit breaker.

9. A circuit breaker, comprising:

a disconnecting device according to claim 1.

* * * * *